US005186758A

United States Patent [19]

Hartman

[11] Patent Number: 5,186,758

[45] Date of Patent: Feb. 16, 1993

[54] ENVIRONMENTALLY-FRIENDLY BATTERY CLEANING METHOD

[76] Inventor: Robert Hartman, Box 1, Thaxton, Va. 24174

[21] Appl. No.: 743,464

[22] Filed: Aug. 9, 1991

[51] Int. Cl.[5] ..... B08B 3/02; C23G 5/032

[52] U.S. Cl. ..... 134/10; 134/13; 134/26; 134/29; 134/95.1; 134/111

[58] Field of Search ..... 134/10, 25.1, 25.5, 134/26, 34, 95, 111, 29; 7/13

[56] References Cited

U.S. PATENT DOCUMENTS

| | | | |
|---|---|---|---|
| 4,201,664 | 5/1980 | Hekal | 134/10 |
| 4,281,674 | 8/1981 | Tanaka et al. | 134/171 |
| 4,409,999 | 10/1983 | Pedziwiatr | 134/184 |
| 4,572,746 | 2/1986 | Wegner | 134/26 |
| 4,784,169 | 11/1988 | Striedieck | 134/10 |
| 4,844,743 | 7/1989 | Koblenzer et al. | 134/10 |
| 4,861,385 | 8/1989 | Yagishita | 134/10 |
| 5,034,065 | 7/1991 | Wegner | 134/10 |

*Primary Examiner*—Theodore Morris
*Assistant Examiner*—Saeed Chaudhry

[57] ABSTRACT

A battery cleaning system and process are provided, that make it possible to clean high capacity (12 to 72) volt acid storage batteries using appropriate cleaning solutions and liquids while recovering, cleaning and recycling the washing waste liquids, and minimizing the volume of liquid that has to be discarded.

3 Claims, 4 Drawing Sheets

ENVIRONMENTALLY-FRIENDLY BATTERY CLEANING METHOD

High capacity (12 to 72) volt acid storage batteries of the type in common use for industrial and commercial electric motor vehicles such as fork lifts, vans, baggage handlers, and freight carriers, trucks and loaders, require cleaning at frequent intervals, to remove salts accumulating at the battery terminals, and oil and grease as well as unidentifiable gunks that collect on the battery surfaces. This cleaning is done as a matter of course by the users in their own shops and warehouses, and the acidic washings are usually disposed of down the sewers or at waste disposal dumps. Since the washings are quite acidic, and the residues, petroleum-base gunks, left after the liquids have evaporated are environmentally unacceptable, and special dump liners and other precautions are legally necessary, battery washing has become a highly constrained service that requires special recovery and recycling equipment, which, however, has not been available.

No devices have been proposed for use in battery cleaning that are capable of withstanding attack by the corrosive battery washings, and that collect and recycle the liquids to the extent possible. It has been up to the users to develop their own systems.

In accordance with the present invention, a battery cleaning system and process are provided for high capacity acid storage batteries employed by the average users of electric vehicles, and that collect, clean and recycle the washing liquids, limiting the volume of waste discard liquids from none to a small proportion of that discarded heretofore, and even making possible complete recovery and recycling of such waste liquids, when adequate clean-up systems are included.

This battery cleaning system can, for example reduce waste disposal volume from 15 gallons of washing liquid to a little as one pint, recycling the remainder. Even that volume can be reduced to zero, by evaporation of the water, leaving a solid residue, mostly salts and gunk, which is easily disposed of by small users or put with scrap batteries returned for meltdown. In this way the system can cut water discharge to zero. It is also possible to recycle the waste water to old batteries as the acid-replenishing liquid. There is therefore no connection needed to any sewer line.

The environmentally-acceptable high capacity acid storage battery cleaning system of the invention comprises, in combination:

(1) a foraminous support for a dirty battery;

(2) cleaning means for applying an aqueous cleaning solution under a pressure within the range from about 0.5 to about 30 psi to a dirty battery on the support;

(3) means for collecting dirty aqueous cleaning solution containing dirt and contaminant material suspended therein and draining from the battery and support after application to the battery;

(4) filter means for removing suspended dirt and contaminant material from the dirty aqueous cleaning solution;

(5) pump means for circulating cleaning solution to and recycling clean filtrate from the filter means to the cleaning means;

(6) rinsing means for applying rinsing water under a pressure within the range from about 800 to about 2500 psi to the battery after cleaning;

(7) means for collecting dirty rinsing water from the rinsing;

(8) pump means for circulating rinsing water to the filter means or to the cleaning means, selectable according to the dirtiness of the rinsing water.

It will be apparent that the means (3) for collecting dirty aqueous cleaning solution and the means (7) for collecting dirty rinsing water can be the same, and they are in the embodiment shown in the drawings, and so also can the cleaning means (2) and rinsing means (6), and they are in the embodiment shown in the drawings.

In a preferred embodiment, one or more storage tanks are provided, receiving dirty aqueous cleaning solution, and optionally dirty rinsing solution, with first filter means through which the dirty solution entering the tank passes, and second filter means through which solution leaving the tank passes, in recycling, thus improving the cleanliness of the filtrate recycled from the tank.

The invention further provides a process for cleaning dirty batteries, comprising:

(1) applying an aqueous cleaning solution under a pressure within the range from about 0.5 to about 30 psi to a dirty battery;

(2) collecting dirty cleaning solution containing dirt and contaminants suspended therein and draining from the battery after cleaning;

(3) filtering the collected dirty cleaning solution at least once, thereby removing suspended material therefrom;

(4) recycling clean filtrate from the filtering to the applying step (1);

(5) applying rinsing water under a pressure within the range from about 800 to about 2500 psi to the battery after draining off aqueous cleaning solution;

(6) collecting dirty rinsing water from the rinsing; and (7) recycling dirty rinsing water to the applying step (1) or to the filtering step (3), selectable according to the cleanliness of the rinsing water.

Preferred embodiments of the invention are shown in the drawings, in which:

Figure 1:
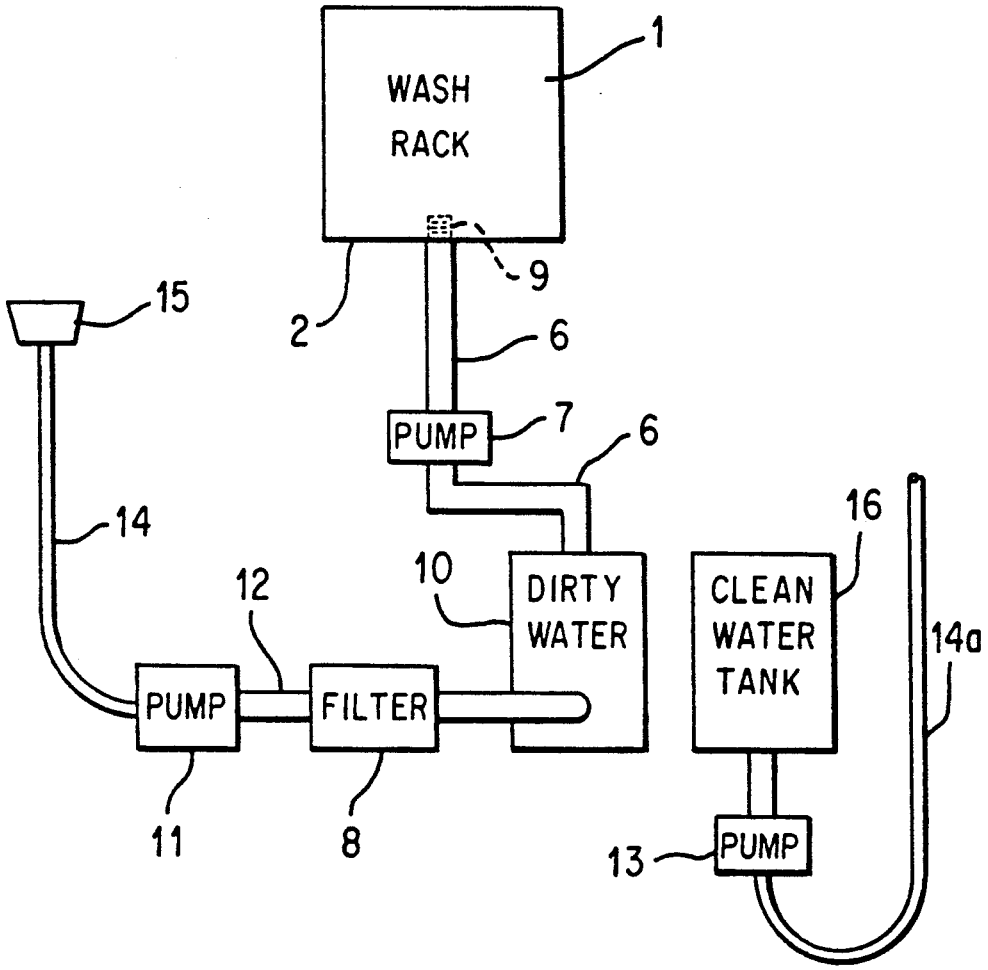
FIG. 1 shows one embodiment of battery cleaning system, using two pumps and two storage tanks; one for clean and one for dirty water.
Figure 2:
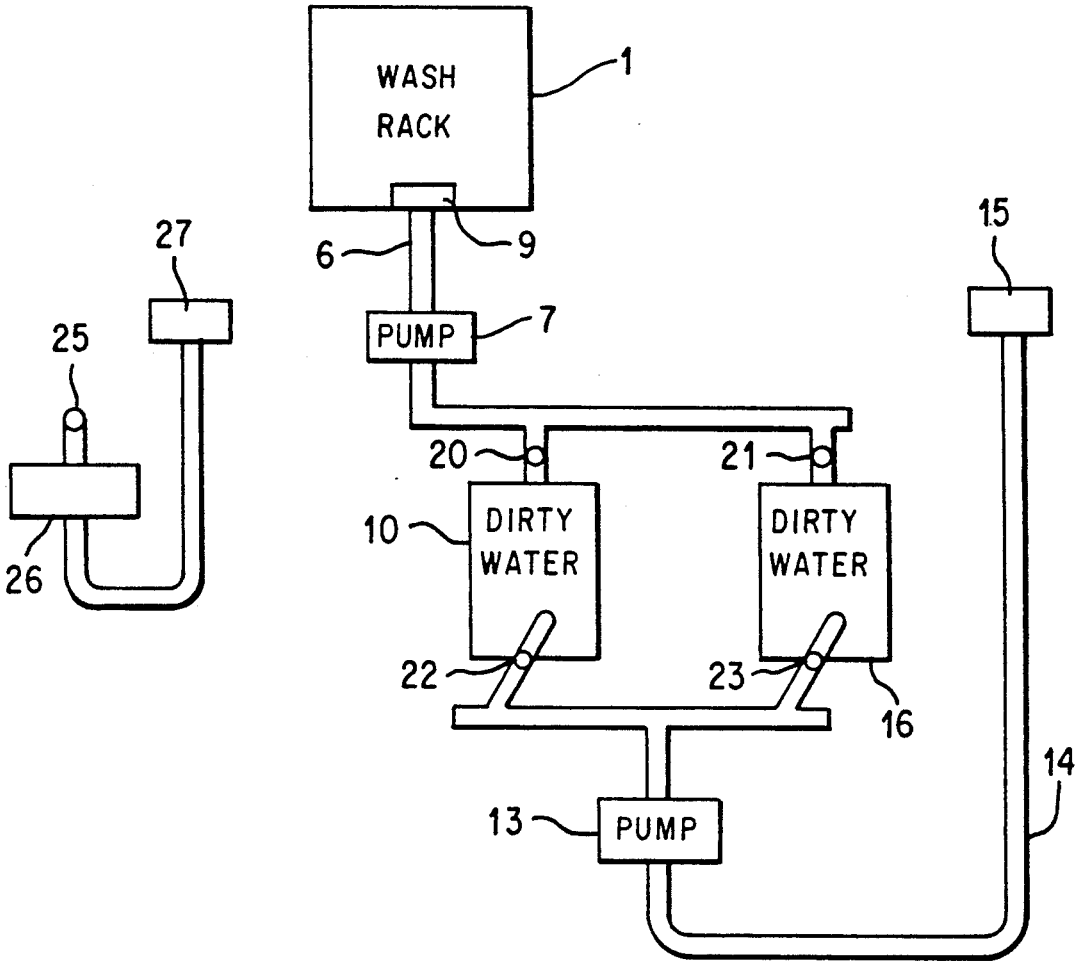
FIG. 2 shows another embodiment of battery cleaning system, using two pumps and two storage tanks, both for dirty water.
Figure 3:
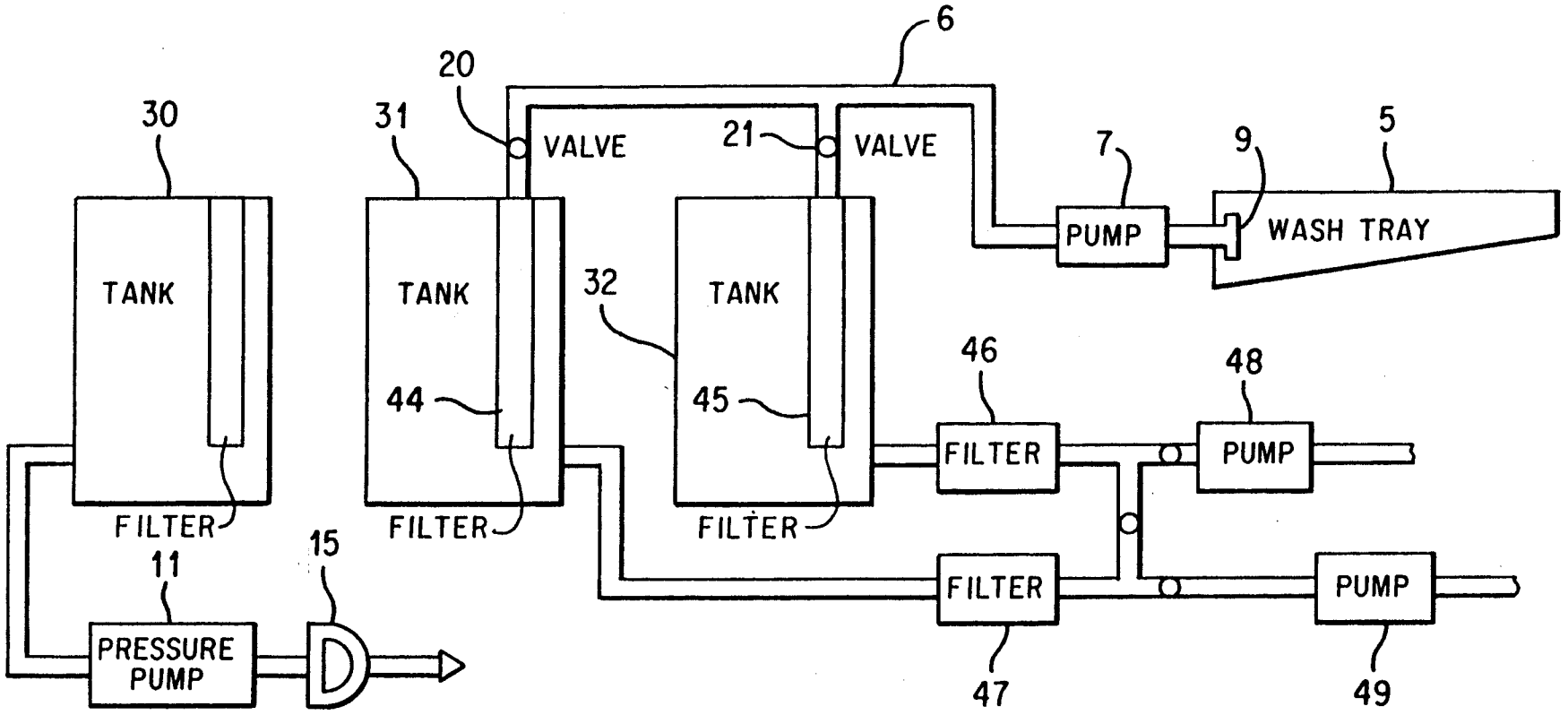
FIG. 3 shows a third embodiment of battery cleaning system, using three pumps and three storage tanks.
Figure 4:
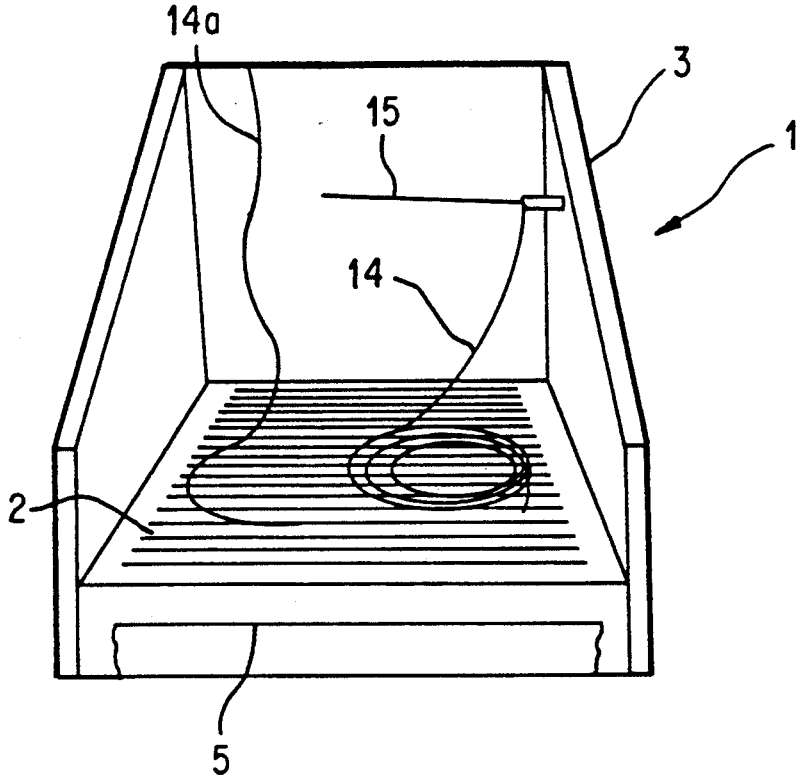
FIG. 4 is a view in perspective of the wash rack of FIGS. 1, 2 and 3.
Figure 5:
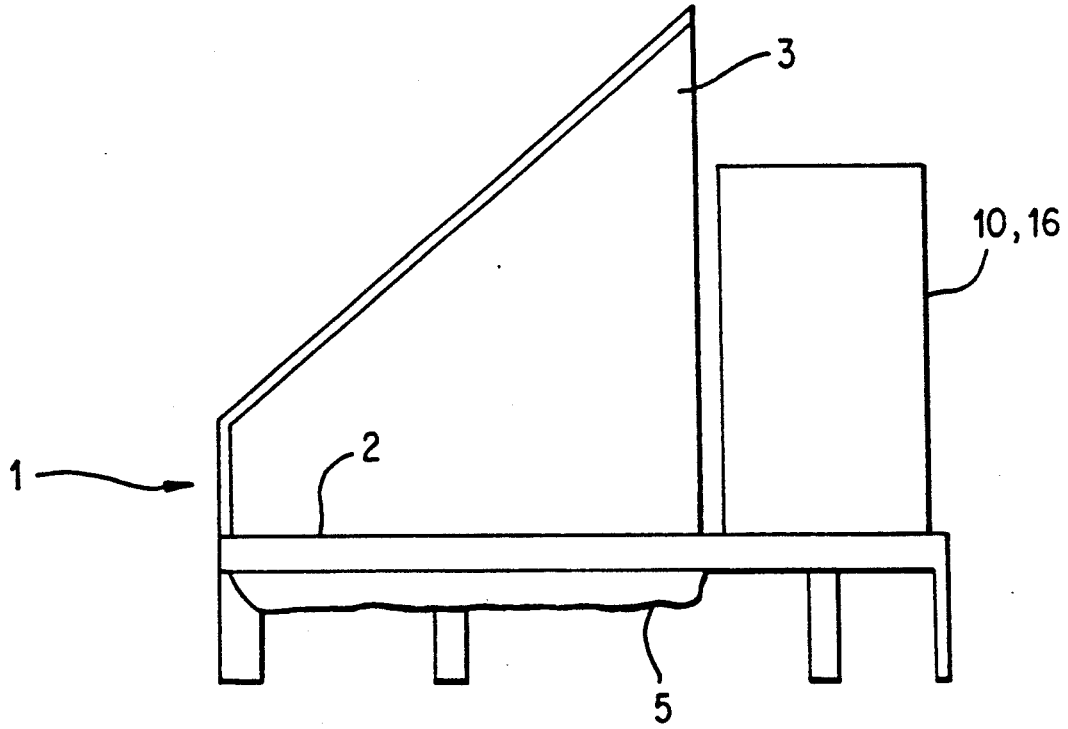
FIG. 5 is a side view of the wash rack of FIG. 4, showing the tray beneath the rack to collect the wash water.

The battery cleaning system of FIGS. 1, 2 and 3, best seen in FIGS. 4 and 5, has a wash rack 1, with a foraminous floor, which in this embodiment is a wooden grate 2, and a protective splash enclosure 3 to channel the aqueous washing solution to and through the grate 2, beneath which it is collected in tray 5. The line 6 drains the tray via coarse screen 9, removing suspended material of larger size, and leads the collected dirty washing solution to pump 7 whence it is accumulated in storage tank 10. From there, it is fed via line 12 through filter 8, where suspended smaller-size material, including dirt and contaminants, is removed. The clean filtrate is pumped by pump 11 through line 12 back through the pressure hose 14 to the spraying wand and nozzle 15, where the recycled washing solution is once more applied to the battery, this time as washing or as rinsing solution.

From time to time, as the recycled solution accumulates dirt material not removed in the filters, some of the recycled solution has to be withdrawn, and replaced with clean water. This is held in storage tank 16, and fed by pump 13 to the pressure hose 14 and nozzle 15 in a hose 14*a*, as required.

The water content of the recycled solution that is withdrawn can be recovered by distillation and recycled as clean water, or simply allowed to evaporate if air temperatures are high enough, and clean water plentiful. The solid residue, salts and gunk, can be dumped or disposed of with scrap batteries that are collected for meltdown. The salts can be separated from the gunk by leaching, and recycled if they are clean enough.

Also, from time to time, the active cleaning detergent and/or buffer in the washing solution have to be replenished. Any conventional detergents can be used, and an alkaline buffer to counteract the battery acids, such as sodium carbonate or sodium bicarbonate, can also be added.

The battery cleaning system of FIG. 2 is similar to that of FIG. 1, but in operation uses both storage tanks 10, 16 for dirty washing solution. The valves 20, 21 and 22, 23 control flow through the selected tank that is on-stream, and close off the other tank, whose contents can be treated while in storage to clean up the water, such as by circulating the water through a filter within the tank, and the detergent and buffer chemicals replenished. The rinsing water can be supplied directly from the supply via and valve 25 by pump 26 to the wand 27.

The battery cleaning system of FIG. 3 is in effect a combination of that of FIGS. 1 and 2 into one. There are three storage tanks 30, 31, 32, of which 31 and 32 are for dirty water and 30 for clean washing solution, fed to the wand and spray head 15 via pump 11 from wash tray 5 and pump 7. As in the system of FIG. 1, the water used in cleaning the battery and collected in tray 5 passes through screen filter 9, where coarse material is removed, and then via line 6 and pump 7 to either tank 31 or tank 32, as determined by valves 20, 21. The solution passes through the second filter 44, 45 into the tank, where the smaller size suspended dirt and contaminants are removed, and then held in the tank for recycling. The cleaned filtrate passes through the third filter 46, 47 for a further cleaning, and then pumped by pump 48 or 49 through line 37 back to the washing step, pump 11 and spray head and wand 15. While the liquid is being held in the tank 32, 33, the detergent and buffer salt content can be replenished.

Alternatively, the filtrate from tanks 31, 32 can be recycled to tank 30, and combined with the clean water fed from this tank to wash or to rinse off the battery.

In the systems of FIGS. 2 and 3, the discards can be disposed of or processed as described above in connection with FIG. 1.

Having regard to the foregoing disclosure, the following is claimed as the inventive and patentable embodiments thereof:

1. An environmentally-acceptable process for cleaning dirty high-capacity acid storage batteries after use, comprising:

(1) applying an aqueous cleaning solution containing (a) active cleaning detergent and (b) alkaline buffer, wherein aqueous cleaning solution having a pH at least 8, under a pressure within the range from about 0.5 to about 30 psi to a dirty battery;

(2) collecting dirty cleaning solution containing dirt and contaminants suspended therein and draining from the battery after cleaning;

(3) filtering the collected dirty cleaning solution at least once, thereby removing suspended material therefrom;

(4) recycling clean filtrate from the filtering to the supplying step (1);

(5) applying rinsing water under a pressure within the range from about 800 to about 2500 psi to the battery after draining off aqueous cleaning solution;

(6) collecting dirty rinsing water from the rinsing; and (7) recycling dirty rinsing water to the applying step (1) or to the filtering step (3), selectable according to the cleanliness of the rinsing water.

2. An environmentally-acceptable process for cleaning dirty high-capacity acid storage batteries according to claim 1, comprising filtering dirty aqueous cleaning or rinsing solution, storing filtrate for reuse, and then filtering the filtrate again prior to recycling, thus improving the cleanliness of the recycled filtrate.

3. An environmentally-acceptable process for cleaning high-capacity acid storage batteries according to claim 1, comprising withdrawing a portion of the dirty aqueous cleaning or rinsing solution and evaporating water from the withdrawn portion, thereby obtaining a solid residue, and replenishing the clean recycled filtrate with clean water, and cleaning chemicals if necessary.

* * * * *